United States Patent [19]

Kuhr

[11] 4,232,594

[45] Nov. 11, 1980

[54] MODULAR CEILING PANEL UNIT USABLE WITH AIR DISTRIBUTION SYSTEMS

[75] Inventor: Albert F. Kuhr, Elk Grove Village, Ill.

[73] Assignee: United States Gypsum Company, Chicago, Ill.

[21] Appl. No.: 928,770

[22] Filed: Jul. 27, 1978

[51] Int. Cl.[3] ..... F24F 7/00

[52] U.S. Cl. ..... 98/40 D; 98/40 C; 98/40 R

[58] Field of Search ..... 98/40 D, 40 R, 40 C

[56] References Cited

U.S. PATENT DOCUMENTS

| | | | |
|---|---|---|---|
| 2,991,708 | 7/1961 | Falk et al. | 98/40 DL |
| 3,204,547 | 9/1965 | Ericson | 98/40 D |
| 3,250,204 | 5/1966 | Zuranski | 98/40 DL |
| 3,325,954 | 6/1967 | Olson | 98/40 DL |
| 3,636,340 | 1/1972 | Mulvey | 98/40 DL |
| 3,831,506 | 8/1974 | Landheer | 98/40 D |
| 3,848,385 | 11/1974 | Thompson | 98/40 DL |
| 3,945,306 | 3/1976 | Brown | 98/40 D |

OTHER PUBLICATIONS

Air Distribution Products, 1971, AIA, File No. 30J, p. 254–279, by Titus Manufacturing Corp., Waterloo, Iowa.

*Primary Examiner*—Henry C. Yuen

*Attorney, Agent, or Firm*—Glenn W. Ohlson; Robert H. Robinson; Kenneth E. Roberts

[57] ABSTRACT

A modular ceiling panel unit adapted for use with conventional air distribution mechanisms in suspended ceiling grid systems utilizing inverted-T runners suspended from upper support structures is disclosed. The panel unit has a body portion having a rectangular configuration with opposite parallel panel faces and four edges. At least two of the opposite panel edges have generally H-shaped integral air distribution strips, having an inner, an outer, and cross-web portion therebetween, fixedly engaged thereto for substantially the full length of the edge. The air distribution strips comprise means along the inner leg of the H-shape engaging the panel body portion edge and means at the outer leg of the H-shape supportively associated with an arm of an inverted-T runner. The cross-web of the H-shaped air distribution strip is adapted to supportively associate with a mounting portion of a conventional air distribution mechanism positioned in the plenum between the ceiling grid system and upper support structure.

3 Claims, 9 Drawing Figures

MODULAR CEILING PANEL UNIT USABLE WITH AIR DISTRIBUTION SYSTEMS

THE BACKGROUND OF THE INVENTION (1) Field of the Invention

This invention relates to a modular ceiling panel unit adapted for use with conventional air distribution mechanisms in suspended ceiling grid systems utilizing inverted-T runners.

(2) Description of the Prior Art

Air diffusers and distributors which provide supply and return of conditioned air in suspended ceiling room systems have been provided in many forms for controlling the cooling, heating, and ventilating of the room environment below. Varied combinations of air distribution mechanisms and ceiling fixtures have been utilized including: linear support runner diffusers; light troffer assemblies having diffusion capabilities; louvered ceiling panels; and, combinations of all. Incorporated with the elements through which the air is diffused are the operating mechanisms causing the return and supply. These include units which pressurize the plenum above the diffusion assembly and those in which the conditioned air is piped into a return or supply air box which rests atop the sub-ceiling at prearranged locations.

One example of a diffuser in a suspended ceiling system is shown in U.S. Pat. No. 3,406,623, issued to Lambert. This assembly provides an air diffuser which rests atop an inverted-T runner and provides an outlet channel including a weir means for directing air passage. The air diffuser also includes tile supporting means at the side opposite the inverted-T runner. Where such an air diffuser is provided, a break in the aesthetic continuity of the grid-like subceiling is obtained because at diffuser locations ceiling tile must be set back to allow for the inlet/outlet opening.

One attempt to provide an air diffuser assembly for use with an air plenum chamber is shown in U.S. Pat. No. 3,590,719, also issued to Lambert. This assembly provides a panel unit for accepting air diffusion means which provides peripheral and central passages utilizing inner and outer frame members. The direction and volume of air flow is selectively controlled by restricting passageway openings with the use of U-shaped channel members within the framework of the unit. The assembly is a complex panel unit which provides many of the operational functions which the air distribution mechanisms normally provide, such as the closing and opening of passages, and, selectivity of direction of air flow. The design contemplates the use of an air plenum chamber which provides pressurized air to the panel unit. Thereafter, the panel unit itself provides the normal diffusion selection and control operation.

Examples of diffusion systems which incorporate both ventilating and lighting fixtures are shown in the following systems: U.S. Pat. No. 3,181,450 issued to Kruger; U.S. Pat. No. 3,246,137, issued to Zagel; and, U.S. Pat. No. 3,250,204, issued to Zurawski. All of these provide similar light troffers having ventilation means along opposite longitudinal edges at the sub-ceiling interface. The peripheral, or marginal, edges are designed to rest on, and communicate with, the support runner system for the sub-ceiling. A pressurized bar, or air box, straddles the light troffer with opposite pressurized air flow ducts. The air flow ducts contact the marginal edges of the troffer assembly to provide the supply or return through slotting in these marginal edges. These last mentioned patents provide various means for the control, selection and direction of the intake/outlet air supply. They all specifically involve assemblies which combine both a light fixture and ventilator construction.

Examples of air distribution system involving fully pressurized plenums typically provide perforated panel units or linear diffusers residing along support runner elements. One system, for example, utilizes valve ports between panels. This is shown in U.S. Pat. No. 3,204,547, issued to Ericson, wherein a slotted first channel member is positioned between ceiling tile and has a longitudinally movable second channel member contained inside the channel which may be slid to alternatively register with slots to allow air passage therethrough or cover the slots to prevent this passage. Thus a ported dual element channel is provided between ceiling tile specially adapted to supportively associate with conventional sub-ceiling support runners.

Another pressurized plenum ventilated ceiling construction is disclosed in U.S. Pat. No. 3,543,669, issued to Kodaras. In this construction the ventilating unit composes elongated strips substantially L-shaped in cross-section. The unit is secured to the lower side of ceiling tile and rests atop the flanges of the inverted-T runner in a suspended ceiling system. A flange of the elongated strip includes slotting for passage of air from the pressurized plenum to the room below. No provision is involved for the adaption of the assembly for use with air distribution box, bar, or boot mechanisms which rest atop the sub-ceiling at prearranged locations. In providing the outlets for the pressurized air in the plenum, the assembly is limited to the so-called exposed grid system wherein the inverted-T runners are visible when viewed from below. No provision is made for kerfed edge ceiling tile wherein the inverted-T runner may be concealed.

In U.S. Pat. No. 3,782,082, issued to Smith et al., a ceiling filter system is provided. In this system a pressurized plenum is provided above the sub-ceiling. A foraminous filtering ceiling panel unit is disclosed for utilization in "clean room" activities. In this manner the control of direction and flow is maintained by the pressurization of the plenum as a whole.

Many types of air diffusion mechanisms are in usage today in the building industry. For example, diffuser units manufactured by Tuttle and Bailey Company, New Britain, Conn., a division of Allied Thermal Corporation, provides diffuser units for modular ceilings utilizing various runner formations as well as diffusers for ventilated light troffer assemblies. Typical spacing of inlet/outlet air ducts are provided to be compatible with conventional ceiling tile widths and lengths. Another widely used line of air distribution systems is provided by Titus Manufacturing Corporation, Waterloo, Iowa. In its brochure entitled, "Air Distribution Products," 1971, A.I.A. File No. 30J, pages 254 -279, assorted air diffusion systems are provided for suspended ceilings involving several types of air bar and ducting conformations.

The prior art discloses assorted linear runner assemblies for adaptation with air diffusers. It also discloses linear runners which are usable with pressurized plenums rather than air bar type diffusers. No system is provided which or would allow the ingress and egress of air through a unitized ceiling panel modular unit adaptable for use with the conventional air distribution boxes and bars as well as in pressurized plenum construction. Similarly, an aesthetically pleasing, continuous line, ceiling panel arrangement usable with sub-ceiling air distribution systems is not disclosed by the prior art in a modular ceiling panel unit having such usage.

(3) Objects of the Invention

It is a primary object of this invention to provide a modular ceiling panel unit adaptable for use with conventional air diffuser units and pressurized plenum systems.

It is additionally an important object of this invention to provide a modular ceiling panel unit usable in suspended ceiling systems wherein inverted-T runners provide a grid-like sub-ceiling.

It is additionally an object of this invention to provide a modular ceiling panel unit having aesthetically pleasing and uninterrupted viewable surfaces.

It is another important object of this invention to provide a modular ceiling panel unit adaptable with air diffusers wherein inverted-T runner support elements may be provided in either an exposed or concealed conformation when viewed from below.

It is an allied object of this invention to provide a modular ceiling panel unit usable with air distribution systems wherein two opposite marginal edges or four marginal edges are provided with air distribution strips.

It is a concomitant object of this invention to provide a sub-ceiling system utilizing both functional modular ceiling panel units usable with air distribution systems and modular ceiling panel units which are matching non-functional blanks that allow for a continuous decorative surface when viewed from below.

SUMMARY OF THE INVENTION

The objects of this invention are attained by providing a ceiling panel unit adapted for use with conventional air distribution mechanisms and suspended ceiling grid systems utilizing inverted-T runners suspended from upper support structures. The ceiling panel unit of this invention for solving the problems discovered in the prior art has a body portion having a generally rectangular configuration with opposite parallel panel faces. The body portion has four edges and at least two opposite edges have generally H-shaped integral air distribution strips. These strips have an inner leg and outer leg with a cross-web portion therebetween. The air distribution strips are fixedly engaged to the the edge for the full length thereof. The air distribution strips comprise means along the inner leg of the H-shape for engaging the panel body portion and means at the outer leg means for supportively associating with an arm of an inverted-T runner. The cross-web of the H-shaped air distribution strip is adapted to supportively associate with a mounting portion of conventional air distribution mechanisms which are positioned in the plenum between the upper support structure and ceiling grid system.

The objects of this invention are also accomplished by a ceiling panel unit wherein the cross-webs of the H-shaped air distribution strips are slotted to provide openings for ingress to, and egress from, the space below the ceiling grid system for air streams caused by the air distribution mechanisms.

The objects of this invention are additionally attained by providing the air distribution strips in optional alternative configurations wherein the inverted-T runners may be maintained in exposed or concealed alignment when viewed from below.

Similarly, the objects of this invention are attained by providing an internal kerf engaging flange along the metal air distribution strip for unitized engagement with the body portion of the ceiling panel or alternatively providing two flanges along a side of the metal air distribution strip for unitized engagement with the body portion of the ceiling panel residing in the pocket between the flanges.

The objects of this invention are also attained by providing a spacing between opposite metal air distribution strips compatible with conventional air diffuser unit dimensions for supportive association therewith.

BRIEF DESCRIPTION OF THE DRAWINGS

Other objects and advantages of the present invention will become apparent upon reading the following detailed description and upon reference to the drawings, in which.

DESCRIPTION OF THE PREFERRED EMBODIMENTS

Figure 1:
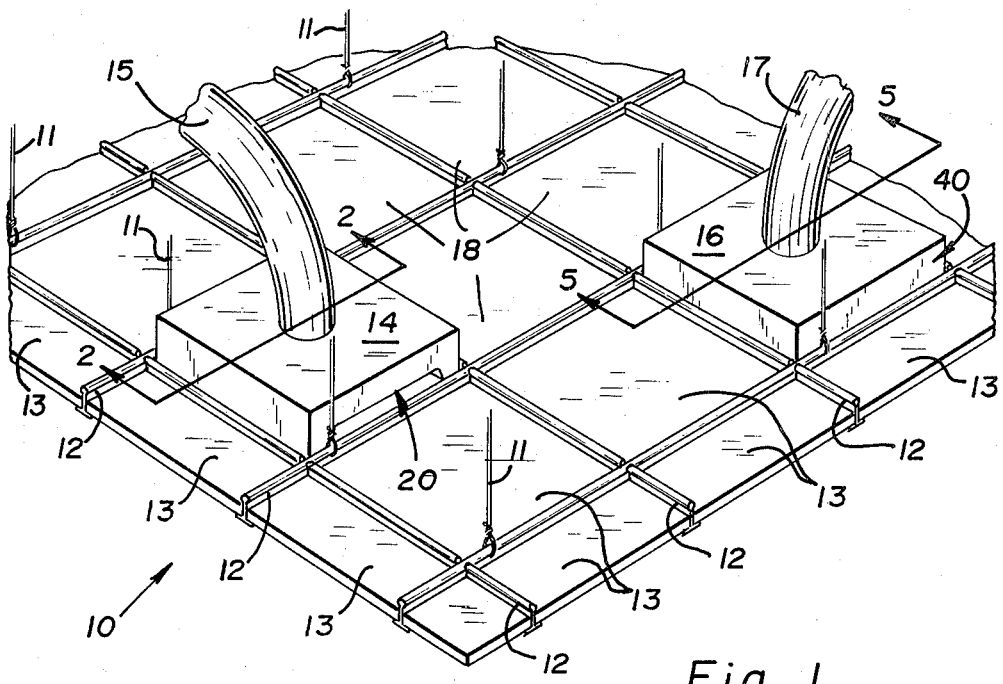
FIG. 1 is a perspective view looking down at a suspended ceiling grid system utilizing the ceiling panel unit provided by this invention in use with conventional air distribution mechanisms.

FIG. 1 illustrates suspended ceiling grid system 10 utilizing the modular ceiling panel unit of this invention. Suspended ceiling grid system 10 is comprised of an upper support structure (not shown) wherein hanger wires 11 depend therefrom to support conventional inverted-T runners 12. In this conventional suspension of inverted-T runners 12 the area between an upper support structure from which suspension is made and the ceiling grid system 10 is generally defined herein as being a plenum. The plenum has a depth corresponding to the distance which hanger wires 11 depend from upper support structures as is well known in the suspended ceiling art. Within this plenum conventional utilities such as light fixtures and air distribution mechanisims are located in a widely used manner. Two conventional air distribution assemblies are positioned above the ceiling. They are illustrated as twin duct bar assembly 14 and full air bar assembly 16. Both air bar assemblies reside in plenum 18 which is the space between the upper support structure and suspended ceiling grid system 10. Air conduit 15 services twin duct air bar assembly 14 and is in contact with a conventional air supply unit located elsewhere in a normal building construction. Likewise, air conduit 17 services full air bar assembly 16 and provides exhaust, supply, or a combination thereof, as required, caused by a remote centralized air distribution unit conventionally used in building construction.

In carrying out the present invention, a two strip modular panel unit 20 and a four strip modular panel unit 40 are provided in suspended ceiling grid system 10. In the preferred embodiment shown in FIG. 1, conventional ceiling tile 13 are located in adjacent grids surrounding the modular panel units. Pursuant to the present invention, the overall outside dimensions of the two strip modular panel unit 20 and four strip modular panel unit 40 are substantially the same as ceiling tile 13 and thus compatibly fit conventional grid system spacing. The conventional tile are provided in 1'×1', 1'×2', 2'×2' and 2'×4' size panel units. However, in keeping with the principles of this invention, the modular panel unit can be readily manufactured with the necessary dimensions for compatibility in a particular grid system.

Figure 2:
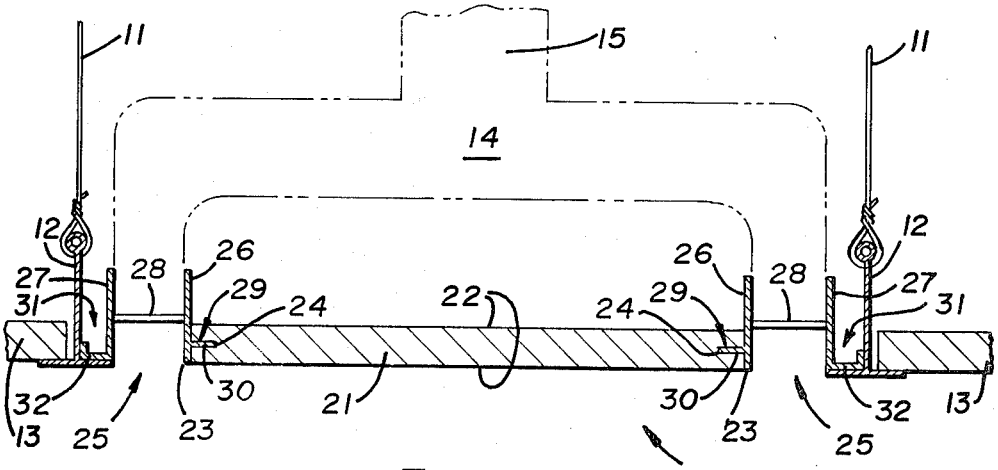
FIG. 2 is a cross-sectional view of the ceiling panel unit according to this invention taken along lines 2—2 of FIG. 1 looking in the direction of the arrows.
Figure 3:
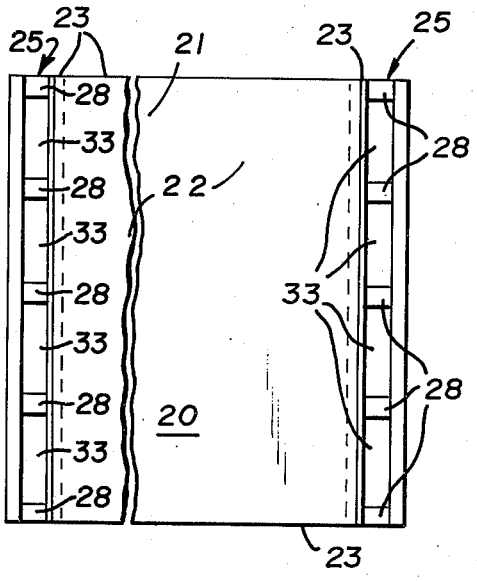
FIG. 3 is a bottom view of one embodiment of the ceiling panel unit in accordance with this invention looking upward as a unit would be viewed from below when in position.

The two strip modular panel unit 20 can be more specifically viewed when turning to FIGS. 2 and 3. FIG. 2 is a cross-sectional view taken along lines 2—2 of FIG. 1 looking in the direction of the arrows. FIG. 3 is a plan view of the two strip modular panel unit 20 of FIG. 1 viewed from below looking upward at the suspended ceiling grid system 10.

Two strip modular panel unit 20 is comprised of a body portion 21 and two H-shaped air distribution strips 25 at opposite sides. The body portion 21 is basically a rectangular sheet and is comprised of two opposite faces 22. Body portion 21 has four marginal edges 23. Kerfs 24 are provided along two opposite marginal edges 23 of body portion 21, and provide a fixed attachment means, discussed below, for air distribution strips 25. The H-shaped air distribution strips 25 are composed of inner legs 26 and outer legs 27 which are the vertical legs of the "H". An integral cross-web 28 extends between, and connects, inner leg 26 with outer leg 27 and completes the "H" shape. In this embodiment of the invention, marginal edges engaging means 29 are comprised of an inward flange 30. Inward flange 30 resides supportively within kerfs 24 which extend substantially along the full length of two opposite marginal edges 23. Inward flange 30 extends inward from a point on inner leg 26 at a sufficient distance such that lower face 22 does not extend below the bottom end of inner leg 26. At the opposite side of H-shaped air distribution strip 25 inverted-T supportive association means 31 is provided for engagement with inverted-T 12. Means 31 comprises an outward flange 32 extending outwardly from the bottom of outer leg 27 for a distance substantially equal to the length of an arm of inverted-T 12. As shown in this embodiment of the invention, outward flange 32 rests atop the arm of inverted-T 12 for supportive association between the two strip modular panel unit 20 and inverted-T runner 12.

The embodiment shown in FIGS. 2 and 3 for the two strip modular panel unit 20 provides and exposed inverted-T runner grid system when viewed from below. As seen best in FIG. 2, the bottom of the arms of inverted-T runners 12 reside below lower surfaces of ceiling tile 13 and two strip modular panel unit 20 to thereby provide an exposed grid configuration.

With specific reference to FIG. 3, the air distribution provision of two strip modular panel unit 20 is depicted. Cross-web 28 is provided with slots 33. The remaining portions of cross-web 28 provide means for mounting twin duct air bar assembly 14. The slotting may be provided in any desirable spacing required by particular needs. In keeping with this invention, an air distribution strip 25 at one side of the modular panel unit 20 may communicate with a supply duct and the stream of air would then be into the room space below the ceiling, while at the opposite side of the unit, the other air distribution strip 25 may communicate with an exhaust duct and thus accommodate an exhaust stream of air passing out of the room space below. In this example, each duct of a twin duct air bar assembly would be serviced by separate conduits, one providing supply and the other exhaust air streams. In the preferred embodiment shown in FIG. 3, two strip modular panel unit 20 is fed by a twin duct air bar assembly 14 providing a supply air stream flow through both ducts and subsequently passes through H-shaped air distribution strips 25 into the room space below.

The two strip modular panel unit 20 shown in FIGS. 2 and 3 is brought to the job site as a modular integral ceiling element. H-shaped air distribution strips 25 are fixedly attached to the marginal edges 23 at the manufacturing plant. It is installed as a "lay-in" modular element for expeditious job site handling and fabrication similar to "laying-in" ceiling tile 13 in the other grid positions.

Figure 4:
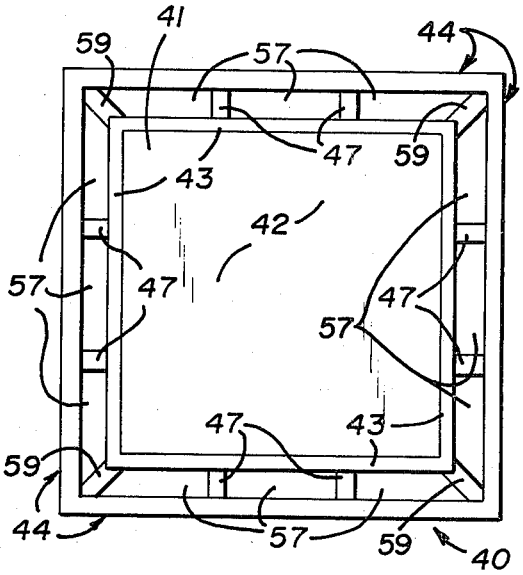
FIG. 4 is a bottom view of one embodiment of the ceiling panel unit in accordance with this invention looking upward as a unit would be viewed from below when in position.
Figure 5:
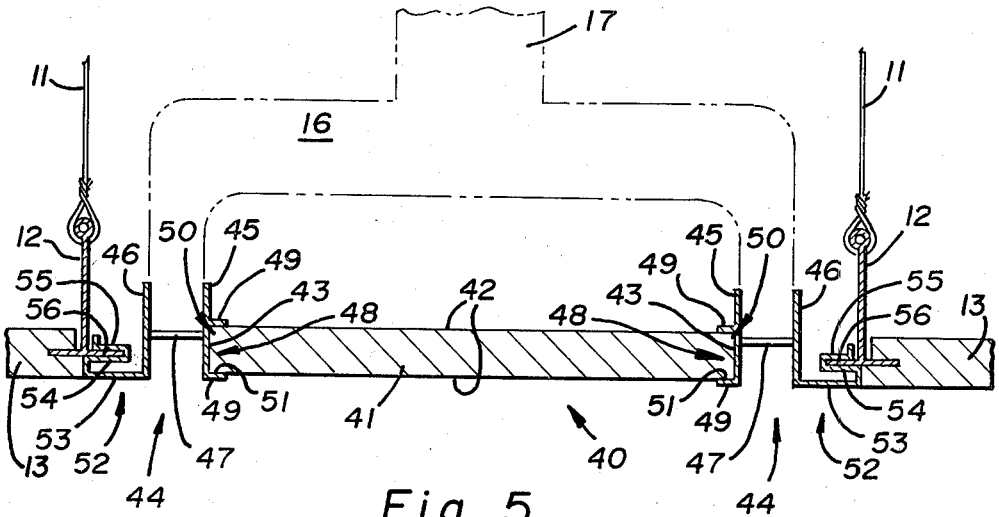
FIG. 5 is a cross-sectional view of an embodiment of the ceiling panel unit in accordance with this invention taken along line 5—5 of FIG. 1 looking in the direction of the arrows.

Looking now at FIGS. 4 and 5, four strip modular panel unit 40 is shown in the preferred embodiment of this invention. FIG. 5 presents a cross-sectional view of FIG. 1 taken along lines 5—5 looking in the direction of the arrows. FIG. 4, similar to FIG. 3, is a plan view looking upward from the room space below the suspended ceiling grid system 10. With reference to FIGS. 2 and 5, it is to be noted that the mounting portions of twin duct air bar assembly 14 and full air bar assembly 16 are shown respectively supported upon cross webs 28 of two strip modular unit 20 and cross web-47 of four strip modular panel unit 40. These mounting portions are conventional elements of air distribution assemblies comprising downwardly disposed opening ducts for passage of air stream therethrough.

Four strip modular panel unit 40 is composed of a body portion 41 and four H-shaped air distribution strips 44. The body portion 41 has opposite faces 42 and four marginal edges 43. Along these marginal edges 43 H-shaped air distribution strips 44 are fixedly attached. The air distribution strips 44 are comprised of inner leg 45 and outer leg 46 connected by cross-web 47 to produce the "H" configuration. Engagement with the marginal edge 43 is provided in this embodiment of the invention by marginal edge engaging means 48. Means 48 is comprised of two parallel arms 49 extending inwardly from inner leg 45 and spaced apart in parallel planar relationship at a distance therebetween of about the thickness of body portion 41. Between arms 49 pocket 50 is created for a "nesting" fixed attachment with marginal edges 43 of body portion 41. Preferably, mastic cement 51 is provided within pocket 50 for an adhesively bonded securement.

At the side of the air distribution strip 44, opposite the marginal edge engaging means 48, there is means 52 providing inverted-T supportive association. Means 52 is comprised of a first flange 53 extending outwardly from a lower end of outer leg 46 which terminates in a second flange 54 extending inwardly but stopping short of outer leg 46. Third flange 55 extends outwardly, but spaced apart in parallel planar relation, from second flange 54. Third flange 55 extends outwardly a distance substantially equal to the length of an arm of inverted-T runner 12. Between second flange 54 and third flange 55 a slot 56 is defined for insertive engagement with an arm of inverted-T runner 12. In the embodiment disclosed in FIGS. 4 and 5, the inverted-T runner 12 is provided in a concealed configuration. When viewed from below, the arms of the runner are hidden within slot 56. The first flange 53 exists in approximate co-planar relationship with the bottom surfaces of ceiling tile 13 and bottom face 42 of body portion 41 to provide a substantially uniform planar ceiling surface.

With specific reference to FIG. 4, the air distribution provision of four strip modular panel unit 40 is illustrated. The cross-webs 47 of the air distribution strips 44 are provided with slots 57. The slotting may be provided in desired spaced relation and arrangement depending on a particular air flow need. The remaining portions of cross-web 47 provide means for mounting full air bar assembly 16 shown in FIGS. 1 and 5. Corners 59 are provided at the intersection joints where the air distribution strips 44 meet at the corners of the body portion 41. They can be overlapped but in the desirable embodiment shown in FIGS. 4 and 5 corners 59 are mitered.

The full air bar assembly 16 supportively associating with four strip modular panel unit 40 is provided in the preferred embodiment as being a chamber whereby a one directional air stream flows through conduit 17. However, it is understood that a full air bar assembly may be provided with separated ducts each fed by a separate conduit such that various combinations of exhaust and supply may be provided through the air distribution strips 44. For example, two opposite strips may provide supply while the remaining opposite two strips have exhaust air streams pass therethrough. Thus by way of example, four strip modular panel unit 40, having four air distributions strips 44 along its peripheral edge, may be provided wherein two opposite air distribution strips 44 have air steams passing downwardly and the other other two opposite air distribution strips 44 have air streams passing upwardly created by a full air bar assembly fed by seperated ducts. A first would cause said downward egress of air at two opposite air distribution strips 44 and a second duct would cause ingress of air streams through the other two opposite air distribution strips 44. In the embodiment disclosed in FIGS. 1, 4 and 5, all four air distribution strips 44 communicating with full air bar assembly 16 are provided to exhaust air from the room space below the suspended ceiling grid system 10 and therefore the air stream flows through slots 57 would be upward from the room space below the ceiling.

FIGS. 6–9 represent the preferred alternative embodiments for the configuration of the air distribution strips usable in either the two or four strip modular panel unit. Particular needs may require the utilization of combinations of these and such is envisioned within the boundaries of this invention.

Figure 6:
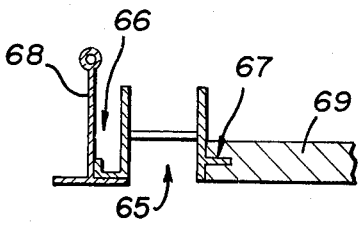
FIG. 6 is an alternative embodiment of the H-shaped air distribution strip configuration substantially identical to the embodiment shown in FIG. 2.

Turning first to FIG. 6, an air distribution strip 65 is provided. This configuration is substantially identical to the H-shaped air distribution strip 25 provided for two strip modular panel unit 20 in the preferred embodiment of this invention shown in FIG. 2. Air distribution strip 65 has means 66 for supportive association with the inverted-T runner 68 in an exposed configuration. At the opposite side, means 67 is provided for engagement with a marginal edge 69 that is kerfed. Means 67 is thus shown to be a flange extending inward in fixed engagement within the kerfed marginal edge 69.

Figure 7:
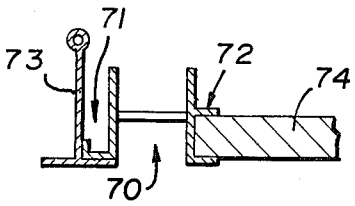
FIG. 7 is an alternative embodiment of the H-shaped air distribution strip configuration in accordance with this invention.

With reference to FIG. 7, another desirable alternative embodiment is illustrated. Similar to air distribution strip 65, air distribution strip 70 provides an exposed system. Means 71 are provided for supportive association with inverted-T runner 73. Means 71 is shown to be a flange resting atop the arm of the inverted-T runner 73 in substantially the same manner as the configuration utilized in air distribution strip 65. At the opposite side of air distribution strip 71, means 72 is provided for engagement with marginal edge 74. Means 72 is illustrated in this embodiment as a pocket defined between two parallel planar spaced apart flanges providing a fixed "nesting" for marginal edge 74. Optionally, a mastic cement is provided within the pocket for adhesive bonding between the air distribution strip 70 and body portion of the panel unit.

Figure 8:
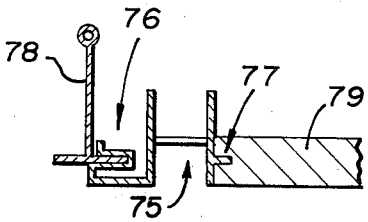
FIG. 8 is an alternative embodiment of the H-shaped air distribution strip configuration in accordance with this invention.

In the alternative desired construction shown in FIG. 8, an air distribution strip 75 is disclosed having means 76 provided for supportive association with inverted-T runner 78. This support is provided by the slotted engagement of an arm of the inverted-T runner 78. This engagement provides a concealed configuration because the arm of the inverted-T runner is not exposed to view from below. At the opposite side of air distribution strip 75, means 77 is provided for engagement with marginal edge 79. Marginal edge 79 is provided with a kerf which is engaged by a flange comprising means 77. The engagement between means 77 and marginal edge 79 is a fixed securement.

Figure 9:
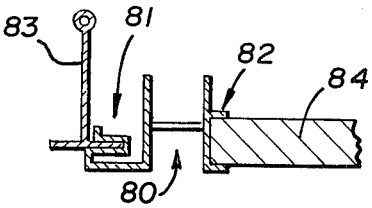
FIG. 9 is an alternative embodiment of the H-shaped air distribution strip configuration substantially identical to the embodiment shown in FIG. 5.

FIG. 9 illustrates another desirable alternative embodiment for an air distribution strip in accordance with the invention and is substantially identical to the configuration provided for H-shaped air distribution strip 44 of four strip marginal panel unit 40 shown in FIGS. 4 and 5. Air distribution strip 80 is provided with a means 81 for supportive association with inverted-T runner 83. Means 81 is shown to be the concealed attachment mode utilizing a slot for discrete engagement of an arm of inverted-T runner 83 to thereby conceal the inverted-T runner 83 when viewed from below. At the opposite side of air distribution strip 80, means 82 is provided for fixed engagement with marginal edge 84. The engagement is provided by a pocket defined between two parallel planar flanges extending outwardly from a leg of the air distribution strip 80. A fixed secure engagement is provided therebetween and may optionally include a mastic cement within the pocket for additional adhesive bonding with marginal edge 84.

The alternate desirable embodiments for the H-shaped air distribution strip shown in FIGS. 6–9 can be combined in a particular modular ceiling panel unit as a specific usage may require. Typically, either the inverted-T runner grid system will be entirely exposed or entirely concealed and thus the combination of the two modes would not be provided. The engagement between the H-shaped air distribution strip and the marginal edge of the body portion of the ceiling panel unit is disclosed in the two alternatively desirable forms shown in these figures. A fixed securement is provided by both alternatives and a modular unit is provided by either fixed engagement. The securement between the air distribution strip and body portion is made at the manufacturing site to provide a one-piece modular unit deliverable to the construction site in ready-to-install form. The overall dimension of the modular unit is compatible with the conventional center-to-center spacing of inverted-T runners in suspended ceiling grid systems. Typically they are provided in 12", 24", or 48" spacings and accordingly the overall dimension of the modular panel unit, in accordance with this invention, is compatible with this spacing for "lay-in" fabrication. This modular ceiling unit sizes are desirably provided in sizes of 1'×1', 1'×2', 2'×2', and 2'×4'; but, within the purview of this invention they may be manufactured to accommodate particular spacing and dimensional requirements encountered.

It is preferred that the H-shaped air distribution strips comprise metal such as cold formed steel, but cold formed aluminum, extruded steel, or extruded aluminum are desirable. Additionally, other materials, such as rigid vinyls, plastics, and the like, may be used.

It is envisioned within the scope of this invention, that a sub-ceiling system may be provided wherein no air bar assemblies are positioned within the plenum. In this manner, the entire plenum would be pressurized by a central air distribution unit which provides air supply and distribution for an entire room or floor, such as in an office building or the like. The slotting in the cross-web of the H-shaped air distribution strips of the modular panel units associated with an individual air supplied plenum would all experience the same directional passage of air caused by the particular supply or exhaust made extant in that plenum.

The modular ceiling panel unit provided by this invention accommodates widely used conventionally sized air bar assemblies by providing a mounting means along the cross-web of the H-shaped air distribution strip with slotting therethrough for the passage of air streams caused by the air bar. The spacing across the modular ceiling panel unit is provided to compatibly adapt to conventional air bar assemblies such as those manufactured by: Barber-Colman Company, Huntsville, Ala.; Anemostat Products Division, Dynamics Corporation of America, Scranton, Penn.; Tuttle and Bailey Incorporated, New Britain, Conn.; and, Thermotank Incorporated, Detroit, Mich. Many of the units provided by these companies utilize a single duct linear strip diffuser, not shown in the Figures, which would lie atop and along only one H-shaped air distribution strip of the modular ceiling panel unit provided by this invention. Also, some air bar units are provided in long narrow shapes, such as 1"×4" units for light troffers. Utility with these and similar air diffusion systems is within the range of the present invention and involve equally adaptable embodiments.

To provide an aesthetically pleasing and continuous ceiling surfaces when viewed from below, blank ceiling panel units may be provided wherein the cross-web of the ceiling panel unit is not slotted. In this configuration, continuous grid lines would be provided for a desirable decorative appearance.

It is apparent that there has been provided, in accordance with the invention, a modular ceiling panel unit usable with air distribution systems that fully attains the objects, aims, and advantages set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and scope of the claims.

Having fully described this new and unique invention the following is claimed:

1. A ceiling panel unit adapted for use with conventional air distribution mechanisms in suspended ceiling grid systems utilizing inverted-T runners suspended from upper support structures forming a plenum between the upper support structure and ceiling grid system, said ceiling panel unit having a body portion having a generally rectangular configuration with opposite parallel panel faces, said body portion having four marginal edges, wherein at least two opposite edges have generally H-shaped integral air distribution strips having an inner leg, an outer leg, and a cross-web portion therebetween, fixedly engaged thereto for substantially the full length of the edge, said air distribution strips comprising means along the inner leg of the H-shape engaging the panel body portion edge and means at the outer leg of the H-shape for supportively associating with the arm of an inverted-T runner, at least one air distribution strip panel edge engaging means comprises a flange projecting inwardly from the inner leg of the H-shape and extending the full length of the strip wherein said flange projects into a kerf provided along substantially the full length of the panel edge thereby providing a fixed attachment, the air distribution strip means for supportively associating with an arm of an inverted-T runner comprises a flange extending outwardly from a lower end of the outer leg of the H-shape and resting atop the arm of the inverted-T to thereby support the panel unit and provide an exposed inverted-T runner configuration when viewed from below, wherein the cross-web of the H-shaped air distribution strip is adapted to supportively associate with a mounting portion of conventional air distribution mechanisms positioned in the plenum between the upper support structure and ceiling grid system.

2. A ceiling panel unit adapted for use with conventional air distribution mechanisms in suspended ceiling grid systems utilizing inverted-T runners suspended from upper support structures forming a plenum between the upper support structure and ceiling grid system, said ceiling panel unit having a body portion having a generally rectangular configuration with opposite parallel panel faces, said body portion having four marginal edges, wherein at least two opposite edges have generally H-shaped integral air distribution strips having an inner leg, an outer leg, and a cross-web portion therebetween, fixedly engaged thereto for substantially the full length of the edge, said air distribution strips comprising means along the inner leg of H-shape engaging the panel body portion edge and means at the outer leg of H-shape for supportively associating with an arm of an inverted-T runner, at least one air distribution strip panel edge engaging means comprises a flange projecting inwardly from the inner leg of the H-shape and extending the full length of the strip wherein said flange projects into a kerf provided along substantially the full length of the panel edge thereby providing a fixed attachment, the air distribution strip means for supportively associating with an arm of an inverted-T runner comprises a first flange extending outwardly from a lower end of the outer leg of the H-shape terminating in a second flange extending inwardly which terminates in a third flange, spaced apart from the second flange, extending outwardly to provide a slot between said second and third flanges engaging the arm of the inverted-T runner therebetween to thereby support the ceiling panel unit and provide a concealed inverted-T runner configuration when viewed from below, wherein the cross-web of H-shaped air distribution strip is adapted to supportably associate with a mounting portion of conventional air distribution mechanisms positioned in the plenum between the upper support structure and ceiling grid system.

3. A ceiling panel unit adapted for use with conventional air distribution mechanisms in suspended ceiling grid systems utilizing inverted-T runners suspended from upper support structures forming a plenum between the upper support structure and ceiling grid system, said ceiling panel unit having a body portion having a generally rectangular configuration with opposite parallel panel faces, said body portion having four marginal edges, wherein at least two opposite edges have generally H-shaped integral air distribution strips having an inner leg, an outer leg, and a cross-web portion therebetween, fixedly engaged thereto for substantially the full length of the edge, said air distribution strips comprising means along the inner leg of the H-shape engaging the panel body portion edge and means at the outer leg of the H-shape for supportively associating with an arm of an inverted-T runner, at least one air distribution strip means for engagement with the panel body portion edge comprises two parallel planar arms projecting inwardly from the inner leg of the H-shape and being spaced apart vertically about the same distance as the thickness of the panel body portion for the full length of said strip, said parallel planar arms providing a pocket therebetween wherein the panel edge resides within the pocket to provide a fixed attachment, the air distribution strip means for supportively associating with an arm of an inverted-T runner comprises a first flange extending outwardly from a lower end of the outer leg of the H-shape terminating in a second flange extending inwardly which terminates in a third flange, spaced apart from the second flange, extending outwardly to provide a slot between said second and third flanges engaging the arm of the inverted-T runner therebetween to thereby support the ceiling panel unit and provide a concealed inverted-T runner configuration when viewed from below, wherein the cross-web of the H-shaped air distribution strip is adapted to supportably associate with a mounting portion of conventional air distribution mechanisms positioned in the plenum between the upper support structure and ceiling grid system.

* * * * *